US010918215B1

(12) United States Patent
Berger

(10) Patent No.: US 10,918,215 B1
(45) Date of Patent: Feb. 16, 2021

(54) PORTABLE, COLLAPSIBLE FOOTSTOOL

(71) Applicant: Stuart Berger, Scarsdale, NY (US)

(72) Inventor: Stuart Berger, Scarsdale, NY (US)

( * ) Notice: Subject to any disclaimer, the term of this patent is extended or adjusted under 35 U.S.C. 154(b) by 0 days.

(21) Appl. No.: 17/011,179

(22) Filed: Sep. 3, 2020

Related U.S. Application Data

(60) Provisional application No. 63/013,933, filed on Apr. 22, 2020.

(51) Int. Cl.

| | |
|---|---|
| ***A45D 29/00*** | (2006.01) |
| ***A47C 16/02*** | (2006.01) |
| ***A61G 7/075*** | (2006.01) |
| *A47L 23/16* | (2006.01) |

(52) U.S. Cl.
CPC ..... *A47C 16/025* (2013.01); *A61G 7/0755* (2013.01); *A45D 29/00* (2013.01); *A47C 16/02* (2013.01); *A47L 23/16* (2013.01); *A61G 2203/70* (2013.01)

(58) Field of Classification Search
CPC ..... A47C 16/025; A47C 16/02; A74L 23/16; A45D 29/00; A61G 7/0755
See application file for complete search history.

(56) References Cited

U.S. PATENT DOCUMENTS

| | | | | |
|---|---|---|---|---|
| 5,379,891 | A * | 1/1995 | Coleman | A47C 9/08 108/119 |
| 9,723,930 | B2 * | 8/2017 | Burch | A47C 16/02 |
| 10,791,826 | B2 * | 10/2020 | Crowe | A47B 21/02 |
| 2005/0151408 | A1 * | 7/2005 | Pratte | A47C 16/025 297/423.39 |
| 2018/0168412 | A1 * | 6/2018 | Pham | A47C 16/025 |
| 2018/0235342 | A1 * | 8/2018 | Wesley | A45D 29/18 |
| 2019/0200722 | A1 * | 7/2019 | Solitt | A45D 29/00 |
| 2020/0093275 | A1 * | 3/2020 | Dolev | A47C 7/748 |

* cited by examiner

*Primary Examiner* — Syed A Islam
(74) *Attorney, Agent, or Firm* — Thomas E. LaGrandeur

(57) ABSTRACT

The presently disclosed footstool comprises a collapsible footstool that is useful for conveniently placing one's foot into comfortable reach to facilitate personal grooming, shoe tying, and the like. The collapsible footrest features a height adjustable footrest that positions one's toes at different selected heights relative to the footstool's table top. The table top includes raised edges that form a tray for holding personal grooming tools and the like. The table top likewise preferably includes a drawer for storing tools and like when not in use. The table top further includes one or more USB ports that power/support optional accessories that plug into the table top, such as a light, magnifying lens, and/or a fan.

6 Claims, 2 Drawing Sheets

PORTABLE, COLLAPSIBLE FOOTSTOOL

CROSS-REFERENCE TO RELATED APPLICATIONS

This application claims priority to U.S. Provisional Application No. 63/013,933 filed Apr. 22, 2020, which is incorporated by reference in its entirety.

FIELD OF THE DISCLOSURE

This disclosure relates generally to the field of a personal footstool.

BACKGROUND

Bending down to reach one's feet to practice personal hygiene on one's feet, tie one's shoes, and so forth can prove difficult for many people for a myriad of reasons, given limitations of flexibility, personal bodily dimensions and other physical limitations.

Accordingly, there is a need in the art for a device that would make it easier and more convenient to readily reach one's feet for personal foot care. The presently disclosed footstool device addresses these needs.

SUMMARY

The disclosure presented herein relates to a portable, collapsible footstool that provides convenience for a person to attend to their foot for personal grooming, shoe tying, and the like.

The footstool preferably includes a table that is supported by collapsible legs that expand to support the table when in use and collapse when not in use and for storage. The legs preferably include non-slip feet on the bottom of the legs.

The table features a height adjustable footrest that rotates about the heel portion of the footrest to allow the toe portion to be raised and lowered. The toe portion is supported by a height adjustable fastening system that securely holds the footrest in different height positions.

The table further features raised edges that enclose the table's top to form a tray that conveniently holds personal grooming tools and the like. In addition, there are inner raised edges that surround the base area in which the footrest lies when fully lowered to form an inner part of the tray.

The table also features one or more USB ports that power and support optional accessories that attach to the table of the footrest. These accessories include, but are not limited to, a light, a magnifying glass, and a fan. The accessories are powered through the USB ports via a battery that lies within the table.

The preceding and following embodiments and descriptions are for illustrative purposes only and are not intended to limit the scope of this disclosure. Other aspects and advantages of this disclosure will become apparent from the following detailed description.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The present description includes one or more embodiments for a collapsible, portable footstool. The footstool may be used for any of a number of applications, such as for pedicure/salon-type treatment of a foot, a rest for tying one's shoes, a shoe shine rack, and so forth. The footstool has a number of features that include, but are not limited to: support legs that are collapsible; a foot rest portion in which the toe end of the foot rest can be raised or lowered; USB port(s) for accessories; optional accessories such as a fan, magnifying lens, and/or light that are preferably powered through a USB port, and an optional storage drawer for storing nail treatment tools and the like. Persons having ordinary skill in the art relevant to the present disclosure understand there may be equivalent elements that may be substituted with those described within the present disclosure.

Figure 1:
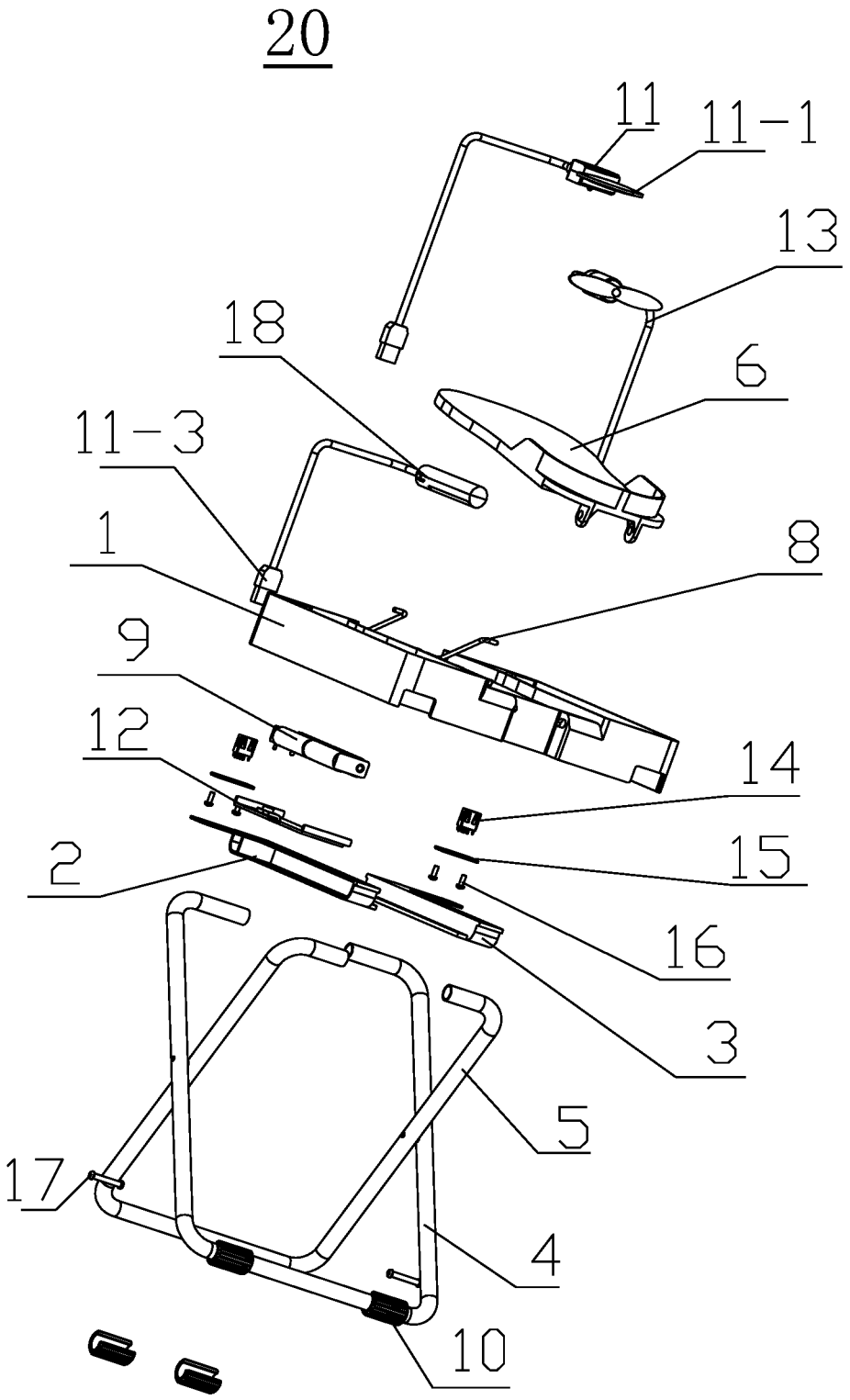
FIG. 1 is an exploded view of an embodiment of a presently disclosed footstool.
Figure 2:
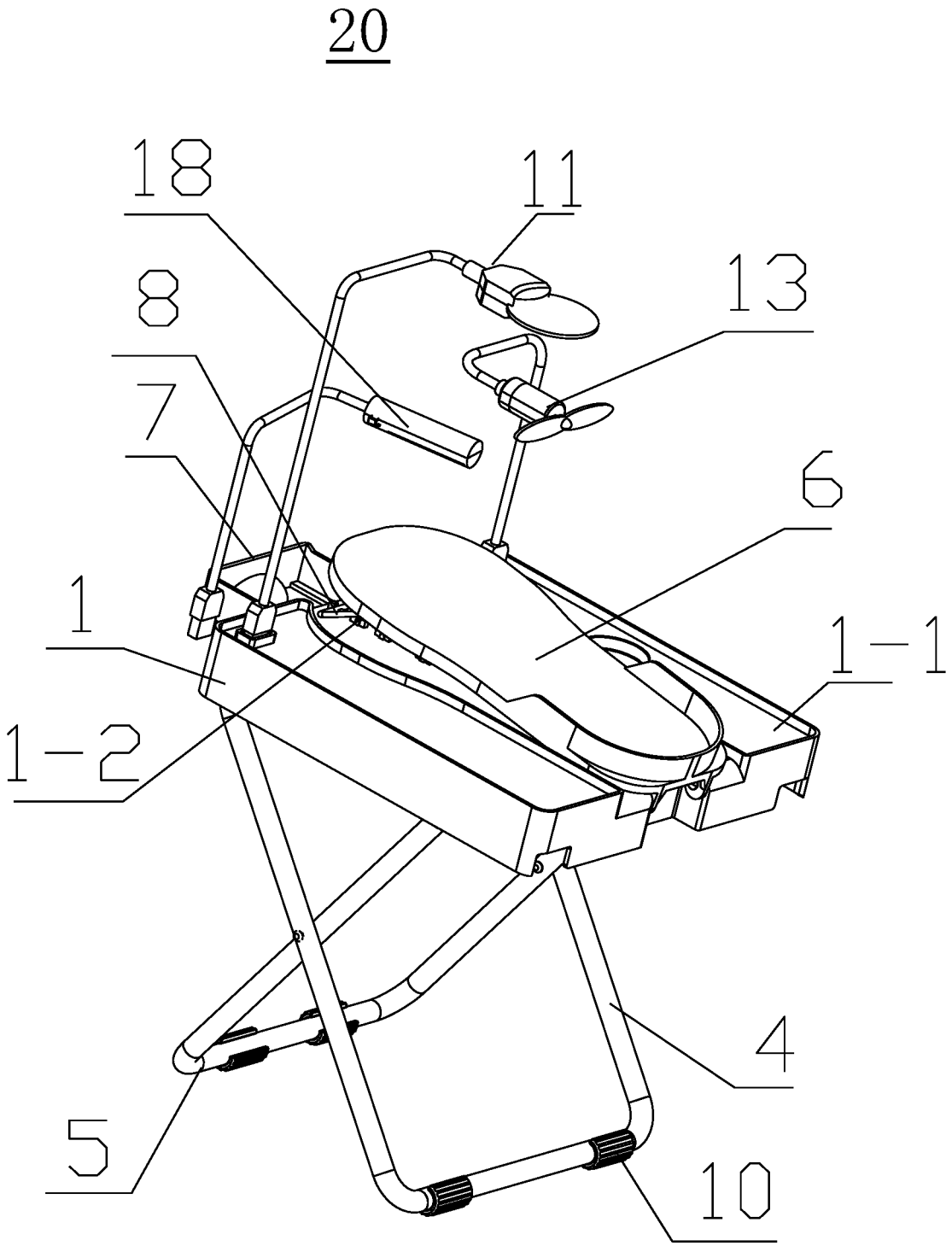
FIG. 2 is a perspective view of an embodiment of a presently disclosed footstool.

As seen in FIGS. 1 and 2, an exemplary preferred embodiment of the presently disclosed footstool is shown. FIG. 1 shows an exploded view of the footstool 20, while FIG. 2 shows a perspective view. The footstool 20 comprises a table 1 that is supported by collapsible legs 4 and 5 that are fixedly attached to the underside of the table. The collapsible legs 4 and 5 form an X-shaped folding legs structure. As shown in FIG. 2, the legs 4 and 5 are fully extended and supporting the table top 1 of the footstool 20. The X-shaped support structure is formed from the U-shaped leg structures 4 and 5, which fold in a scissor-like fashion to compress when the footstool 20 is not in use and likewise unfold/extend when the footstool 20 is in use. The legs 4 and 5 are pivotably connected by pivot pins 17 that reside approximately half way up the U-shaped legs 4 and 5; the pivot pins 17 are shown detached in FIG. 1 for illustrative purposes. As shown in FIG. 2, the legs 4 and 5 pivot about the pivot pins 17 to form an X-shaped support structure when fully extended and snapped into place to support the table top 1. In the preferred embodiment shown in the figures, the open top ends of the U-shaped structures have horizontal end portions configured to snap into groove on the underside of the table. Likewise, the legs 4 and 5 pivot about the pivot pins to compress and lie flat when not in use. As shown in FIG. 2, leg 5 has a smaller width than leg 4 and resides inside the width of leg 4. Preferably, the bottoms of legs 4 and 5 each have one or more non-slip feet or foot pads 10 that are sheathed on lower, floor/ground touching portions of legs 4 and 5.

Turning now to the table 1 of the footstool 20, the table includes a table top 1-1, a footrest 6, a height adjustment portion (1-2 and 8) under the toe portion of the footrest 6, one or more USB ports 14, and an optional drawer 7. The one or more USB ports 14 support and power optional footstool 20 accessories, such as a light 18, a magnifying glass 11, and a fan 13.

The table 1 has an outer raised edge/lip that abuts and surrounds the table top 1-1 to enclose the entire table top and form a tray structure that conveniently can hold pedicure and similar tools, whereby the outer edge/lip prevents tools from inadvertently rolling off the edge of the table top 1-1. Likewise, there is an inner raised edge/lip that surrounds the footrest 6 area and the area occupied by the footrest when the footrest 6 is fully lowered onto the table top 1-1, whereby the inner edge/lip prevents tools from inadvertently rolling into the footrest 6 area.

The footrest 6 is configured for the placement of a person's foot on the footstool 20. The footrest 6 includes a heel portion and a toe portion. The heel portion of the footrest 6 has a raised edge/lip that in conjunction with the base of the footrest 6 forms a heel cup to securely hold a person's foot by the heel and thereby prevent a foot from slipping off the footstool 20. The heel is rotatably attached to the table across the width of the heel, such that the heel portion can rotate about an axis that runs through the width of the heel portion. In this regard, the footrest 6 can be rotated above the height of the top of the table, to provide an angled support for a user's foot.

The toe portion of the footrest 6 is height adjustable, such that the toe of the footrest 6 can lie flat with the table top 1-1 or be raised up, away from the table top 1-1 as shown in FIG. 2. To raise the toe portion of the footrest 6, the toe portion is lifted away from the tabletop, and the heel portion of footrest rotates about the axis that supports the heel portion and attaches it to the table 1. The toe portion of the footrest 6 can be locked into different height positions of varying degrees upward from the table top 1-1, whereby the locking occurs by a height adjustable fastener. In one embodiment, the mechanism by which the footrest 6 is locked into different height positions includes an adjustable brace 8 and grooves 1-2 that accept a U-shaped, rotatable brace 8, such that the continuous bar bottom end of the brace 8 snaps into a groove 1-2 to lock the height of the footrest 6 in place. A number of grooves 1-2 positioned at different positions in the table top 1-1 allow for varying height locked positions of the brace 8, such that the footrest 6 can be angled in a range of heights relative to the table top 1-1, with the heights varying from no height relative to the table top 1-1, to little height, and greater height, as desired by the user of the footstool 20. A greater footrest 6 height will provide a more upward angle of the foot, such that a user might more readily reach the user's toes compared to when the footrest 6 is in a lowered or fully lowered position. As shown in FIG. 2, the footrest 6 is positioned to rotate out of (when raised) and into (when lowered) a raised lip or edge that is contoured such that the footrest 6 lies within the raised lip or edge when the footrest 6 is fully lowered.

The footrest 20 table 1 preferably includes an optional drawer 7 that is integrated into the table and that slides out from under the table top 1-1. The drawer 7 is shown in an open position in FIG. 2. As shown in FIG. 1, the drawer 7 is supported by and held in place by drawer slides/rails 2 and 3 that are positioned in the table 1 underneath the table top 1-1. Preferably, the drawer extends out from the side of the footstool 20 and table 1 that faces away from a user's toes position on the footrest 6.

The table 1 of the footstool 20 includes one or more USB ports 14 that provide power/support to various, optional accessories that can be plugged into the USB ports. As shown in the figures, such optional, USB powered accessories that can be installed into the USB ports 14 and the table 1 include, but are not limited to, a light 18, a magnifying lens/glass 11, and a fan 13. These optional accessories are powered through the USB ports, which in turn are powered by one or more batteries 9 that are secured within a battery compartment that resides within the table 1, whereby the battery is held in place by a battery cover 12. As shown in FIG. 1, the accessories have USB port compatible plugs, such as the plug 11-3 that is connected to the light 18.

The USB ports 14 are installed through a USB wiring board 15, which is held in place by screws 16.

The footstool 20 as presently disclosed preferably includes one or more indentations/wells/cup-like structures in the table top 1-1 configured to hold items, such as a bottle of nail polish and so forth. Accordingly, the table top 1-1 has one or more recessed portions that adjoin and lie below the table top, whereby a recessed portion(s) typically has sidewalls that abut the table top 1-1 and a flat base that lies below the sidewalls.

The footstool 20 shown in FIGS. 1 and 2 and described above is an exemplary, non-limiting embodiment of the presently disclosed footstool. For example, the structure/design of the collapsible legs is not limited to the embodiment depicted as legs 4 and 5. Likewise, the position and assembly of the drawer 7; accessories 18, 11, 13; mechanism of adjusting the footrest 6; placement of battery 9; placement of USB ports 14; and so forth as depicted in the drawing are non-limiting examples/embodiments of the presently disclosed footstool The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The exemplary, preferred embodiment was chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A portable, collapsible footstool consisting of a table, the table supported by collapsible legs fixedly attached to an underside of the table;

a footrest attached to a topside of the table, wherein a heel portion of the footrest is rotatably attached to the topside of the table;

wherein a toe portion of the footrest is removably attached to the table by a height adjustable fastener;

a drawer integrated into the table, wherein the table has a top surrounded by a raised edge that encloses the entire table top, and wherein the table top has an inner raised edge that encloses an area occupied by the footrest when the footrest is fully lowered onto the table top.

2. The portable, collapsible footstool of claim 1, the table further consisting of one or more USB ports.

3. The portable, collapsible footstool of claim 2, further consisting of one or more USB port powered accessories selected from the group consisting of a fan, a light, and a magnifying glass.

4. The portable, collapsible footstool of claim 2, further consisting of two or more USB port powered accessories, wherein the two or more USB port powered accessories consist of a first accessory that is a fan and a second accessory selected from the group consisting of a light and a magnifying glass.

5. The portable, collapsible footstool of claim 2, further consisting of one or more batteries that provide power to the one or more USB ports.

6. A portable, collapsible footstool consisting of a table, the table supported by collapsible legs fixedly attached to an underside of the table;

a footrest attached to a topside of the table, wherein a heel portion of the footrest is rotatably attached to the topside of the table;

wherein a toe portion of the footrest is removably attached to the table by a height adjustable fastener;

two or more USB ports mounted in the table;

two or more USB port powered accessories consisting of a first accessory that is a fan and a second accessory selected from the group consisting of a light and a magnifying glass;

a drawer integrated into the table;

wherein the table has a table top surrounded by a raised edge that encloses the entire table top; and wherein the table top has an inner raised edge that encloses an area occupied by the footrest when the footrest is fully lowered onto the table top.

* * * * *